US005149379A

United States Patent [19]

Gotoh

[11] Patent Number: 5,149,379

[45] Date of Patent: Sep. 22, 1992

[54] METHOD OF CLEANING DRUMS

[75] Inventor: Masaru Gotoh, Nara, Japan

[73] Assignee: Mita Industrial Co., Ltd., Osaka, Japan

[21] Appl. No.: 603,117

[22] Filed: Oct. 25, 1990

[30] Foreign Application Priority Data

Oct. 31, 1989 [JP] Japan ..... 1-285866

[51] Int. Cl.[5] ..... B08B 1/04; B08B 3/02; B08B 3/06

[52] U.S. Cl. ..... 134/10; 134/21; 134/24; 134/26; 134/32; 134/36

[58] Field of Search ..... 134/21, 24, 32, 36, 134/10, 26

[56] References Cited

U.S. PATENT DOCUMENTS 4,196,018 4/1980 Inoko et al. ..... 134/10
4,824,487 4/1989 Heffernan ..... 134/10

OTHER PUBLICATIONS

Patent Abstracts of Japan, vol. 7, No. 118 (C-167) 21 May 1983, & JP-A-58 037173 (Ricoh K.K.) 4 Mar. 1983.

Patent Abstracts of Japan, vol. 13, No. 384 (C-629) (3732) 24 Aug. 1989, & JP-A-1 132788 (Mita Ind., Co., Ltd.) 25 May 1989.

Patent Abstracts of Japan, vol. 13, No. 375 (P-921) (3723) 21 Aug. 1989, & JP-A-1 130159 (Konica Corp.) 23 May 1989.

Patent Abstracts of Japan, vol. 10, No. 354 (P-521) (2410) 28 Nov. 1986, & JP-A-61 151660 (Konishiroku Photo Ind., Co., Ltd.) 10 Jul. 1986.

*Primary Examiner*—Theodore Morris
*Assistant Examiner*—Zeinab El-Arini
*Attorney, Agent, or Firm*—Armstrong, Nikaido, Marmelstein, Kubovcik & Murray

[57] ABSTRACT

The present invention relates to a method of cleaning the outer circumferential surface of a drum by spraying a cleaning fluid thereon and a device for cleaning drums. The cleaning fluid is circulated and is cleaned with a filter during circulation. The drum is cleaned with a cleaning fluid passed through a primary filter having a porous structure at high pressure, after which the drum is cleaned with a cleaning fluid passed through a finishing filter having a fine porous structure. A device for cleaning drums switches a circulating passage for cleaning fluid so that the cleaning fluid can pass through the primary filter at high pressure to spray on the outer circumferential surface of the drum. Also, the device allows the cleaning fluid to pass through the finishing filter at low pressure to spray on the outer circumferential surface.

3 Claims, 2 Drawing Sheets

METHOD OF CLEANING DRUMS

BACKGROUND OF THE INVENTION

1. Field of the Invention

The present invention relates to a method and a device for cleaning drums in the manufacture of photoconductor drums for use with image forming apparatus such as electrophotographic copying machines or the like. More particularly, this invention relates to a method and device for cleaning drums such as aluminum drums or the like, before applying a coating solvent containing a photoconductive substance to the outer circumferential surface of the drum in the manufacture of photoconductor drums having a photoconductive layer formed on the outer circumferential surface thereof.

2. Description of the Prior Art

A photoconductor drum used with an image forming apparatus such as an electrophotographic copying machine or the like is manufactured by coating the outer circumferential surface of an aluminum drum with a photoconductive substance to form a photoconductive layer thereon. Prior to the coating of the photoconductive substance, the aluminum drum is cleaned to remove metal powder, grease, and other foreign matter adhering the surface thereof, so that the photoconductive substance can be applied in a uniform thickness onto the outer circumferential surface thereof.

One known method of cleaning such an aluminum drum is to spray a cleaning fluid onto the outer circumferential surface of the aluminum drum. In this cleaning method, as shown in FIG. 2, a cleaning fluid is sprayed inwardly from nozzles 91 arranged in a circular configuration while an aluminum drum 10 is passed in rotating fashion through the inside space of the circular configuration toward which the cleaning fluid is sprayed. Thus, the cleaning fluid is sprayed onto the outer circumferential surface of the aluminum drum 10 to remove foreign matter adhering thereto. The cleaning fluid after being used for cleaning is collected in a storage tank 92 disposed beneath the nozzle 91. The cleaning fluid 93 in the storage tank 92 is pressurized by means of a pump 94 to feed to a filter 95 through which the cleaning fluid is filtered and cleaned and recirculated to the nozzle 91 for use for cleaning the aluminum drum 10. The cleaning fluid is thus effectively filtered and cleaned and recycled.

With the above drum cleaning method, to assure complete removal of metal powder, grease, and other foreign matter adhering to the outer circumferential surface of the aluminum drum 10, the cleaning fluid usually has to be sprayed through the nozzles 91 under a high pressure of 30–50 kg/cm$^2$. Spraying the cleaning fluid through the nozzles 91 under a high pressure of about 50 kg/cm$^2$ requires that the pressure loss of cleaning fluid must be decreased at the filter 95. Therefore, the filter 95 through which the cleaning fluid fed to the nozzle is passed through has a porous structure coarse enough to allow particles of 10 $\mu$m or larger size to pass through; otherwise, spraying the cleaning fluid under such a high pressure would not be possible because of a decrease in the pressure applied to the cleaning fluid due to the presence of the filter 95. If the filter 95 has a porous structure coarse enough to allow particles of 10 $\mu$m or smaller size to pass through is used, the pressure loss of cleaning fluid must be decreased at the filter 95, because the cleaning fluid cannot be sprayed under high pressure.

After cleaning the aluminum drum 10 used as a photoconductor drum for an image forming apparatus, the minimum allowable size of foreign particles to be deposited on the outer circumferential surface of the aluminum drum 10 is generally said to be about 0.2 $\mu$m. When applying a coating solution containing a photoconductive substance on the cleaned drum surface, if any foreign particles larger than that size are left thereon, the coating solution cannot be applied uniformly where such particles are deposited, resulting in the formation of an image having missing portions on such areas. As described, when the filter 95 having a porous structure coarse enough to allow particles of 10 $\mu$m or larger size to pass through is used, particles larger than the allowable size may not be trapped by the filter 95 and may be redeposited on the outer circumferential surface of the aluminum drum 10, thus resulting in a substantial drop in the cleaning effect even if the cleaning fluid is sprayed under high pressure.

In the case of spraying the cleaning filter under high pressure, if more than one filter having a coarse porous structure is used in parallel with each other, the cleaning fluid can be sprayed under high pressure to the drum surface while reducing the size of foreign particles allowed to pass through the filters. However, such arrangement requires the provision of a large number of filters, which not only impairs economy but could result in failure to completely remove particles in the cleaning fluid which are larger than the allowable size.

SUMMARY OF THE INVENTION

The method of and the device for cleaning drums of this invention, which overcomes the abovediscussed and numerous other disadvantages and deficiencies of the prior art, comprises a primary cleaning process for cleaning the outer circumferential surface of said drum by spraying thereon a cleaning fluid maintained at a prescribed high pressure and cleaned with a primary filter having a porous structure coarse enough to allow said cleaning fluid to pass through due to the loss of a prescribed low pressure; and a final cleaning process for cleaning the outer circumferential surface of said drum cleaned in the primary cleaning process, by spraying thereon a cleaning fluid passed through a finishing filter, at a low pressure, having a fine porous structure so as to remove foreign matter which is bigger than or equal to a prescribed size in said cleaning fluid.

In a preferred embodiment, the drum is a photoconductive drum having a photoconductive layer on the circumferential surface thereof after cleaning.

In a preferred embodiment, the primary filter is in size of about 10 $\mu$m so that said cleaning fluid passed through at a high pressure of about 50 kg/cm$^2$ may not lose most of the pressure thereof.

In a preferred embodiment, the finishing filter is about 0.2 $\mu$m in size.

Another device for cleaning a drum of this invention is a device for cleaning a drum by spraying a cleaning fluid on the outer circumferential surface of said drum to clean thereon and by circulating said cleaning fluid cleaned with a filter, which comprises: a nozzle for spraying said cleaning fluid on the outer circumferential surface of said drum; a cleaning tank accommodating said cleaning fluid sprayed on the outer circumferential surface of said drum; a primary fluid passage for circulating said cleaning fluid accommodated in said cleaning tank at a prescribed high pressure into said nozzle; a primary filter which is disposed in said primary fluid passage and allows said cleaning fluid at a prescribed high pressure to pass through at a prescribed loss of low pressure; a secondary fluid passage for circulating said cleaning fluid accommodated in said cleaning tank at a prescribed low pressure into said nozzle; and a finishing filter which is disposed in said secondary fluid passage and removes foreign matters, each having a prescribed size or more.

In a preferred embodiment, the primary fluid passage is connected to a pump for circulating said cleaning fluid at a prescribed high pressure into said passage.

In a preferred embodiment, the secondary fluid passage is divided upstream of said primary filter of said primary fluid passage and joins downstream of said primary fluid passage; and said cleaning fluid flows selectively through either one of said secondary fluid passage or primary fluid passage.

In a preferred embodiment, the primary fluid passage is connected to a bypass passage divided upstream of a position where said secondary passage is divided, and a flow rate adjustment valve for adjusting the pressure of said cleaning fluid flowing inside said secondary fluid passage is provided in said bypass passage.

In a preferred embodiment, the drum is a photoconductive drum having a photoconductive layer formed on the circumferential surface thereof after cleaning.

In a preferred embodiment, the primary filter is about 10 μm in size, so that said cleaning fluid passing through at a high pressure of about 50 kg/cm$^2$ may not lose most of the pressure thereof.

In a preferred embodiment, the finishing filter is about 0.2 μm in size.

Thus, according to the drum cleaning method and device proposed by the present invention, a high-pressure cleaning fluid cleaned with a primary filter is sprayed onto the outer circumferential surface of a drum for effective removal of foreign particles adhering thereto. Furthermore, fine foreign particles passed through the primary filter and redeposited on the drum surface are easily removed using a low-pressure cleaning fluid cleaned with a finishing filter. Therefore, even fine foreign particles deposited on the drum surface can be completely removed by using a relatively small number of filters.

BRIEF DESCRIPTION OF THE DRAWINGS

This invention may be better understood and its numerous objects and advantages will become apparent to those skilled in the art with reference to the accompanying drawings as follows.

DETAILED DESCRIPTION OF THE PREFERRED EMBODIMENTS

The following describes one embodiment of the present invention.

The drum cleaning method and device proposed by the present invention is applied in the manufacture of a photoconductor drum having a photoconductive layer formed on the outer circumferential surface of an aluminum drum, and used to clean the outer circumferential surface of the aluminum drum on which the photoconductive layer is to be formed.

Figure 1:
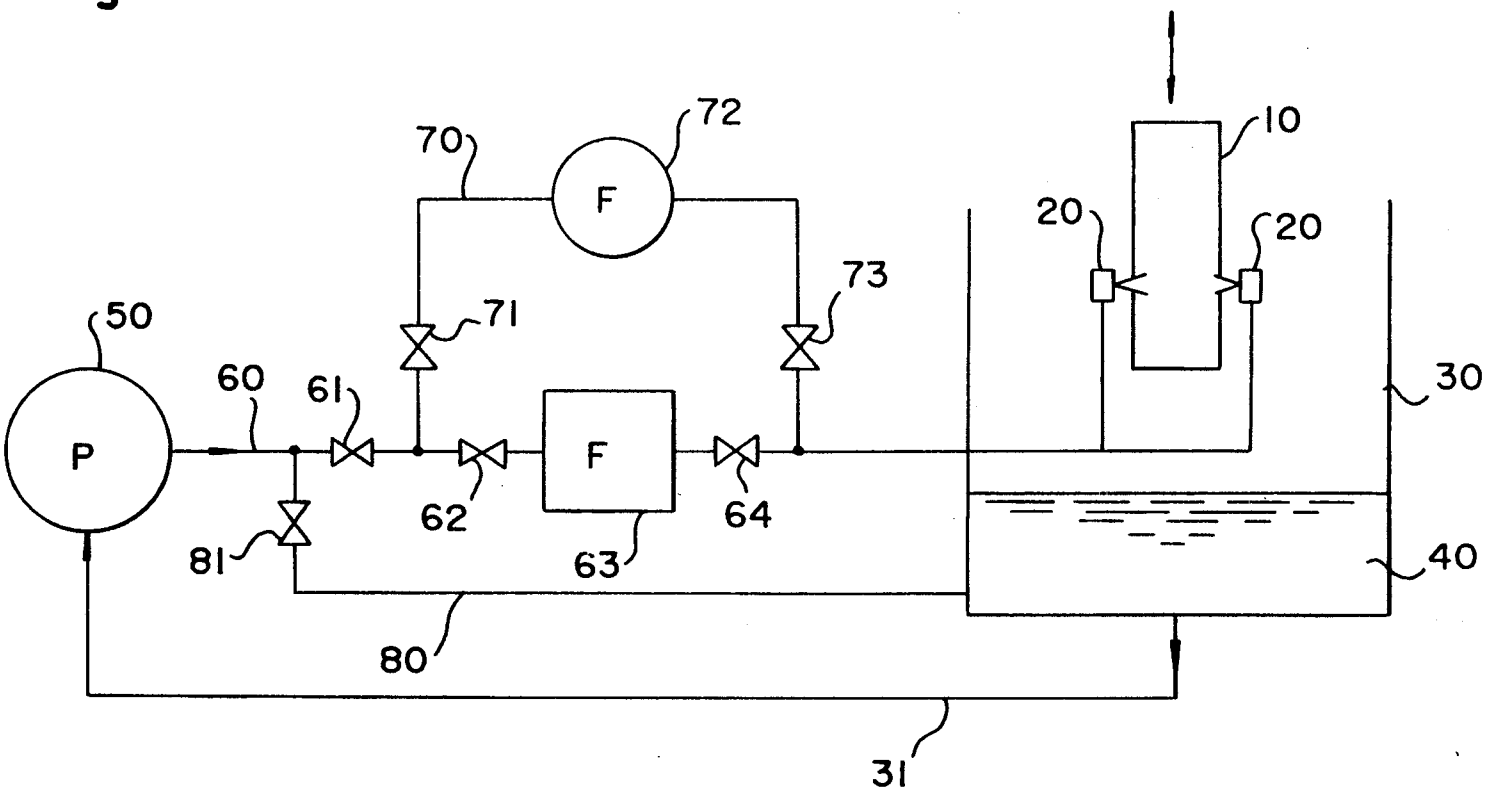
FIG. 1 is a schematic diagram showing a device of the present invention used to carry out the method proposed by the invention.
Figure 2:
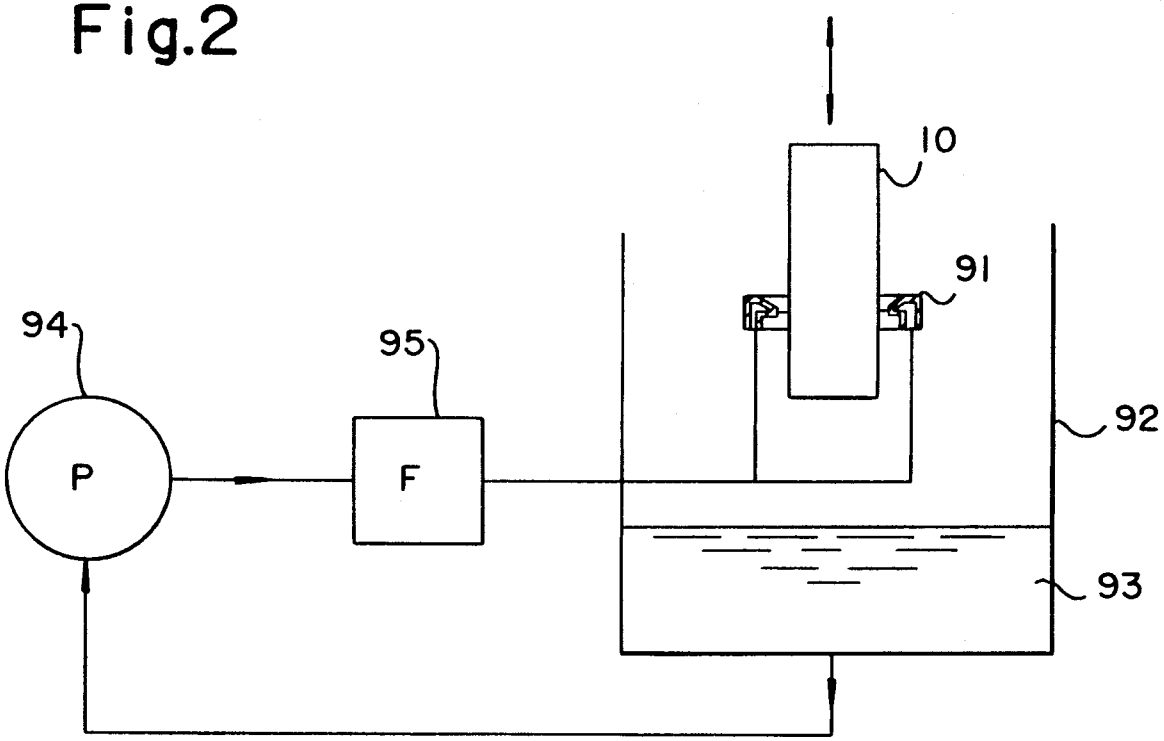
FIG. 2 is a schematic diagram showing a conventional drum cleaning device.

FIG. 1 is a schematic diagram showing the device of the present invention used to carry out the method proposed by the invention. As shown, a cleaning tank 30 which contains a cleaning fluid 40 is disposed beneath an aluminum drum 10 to be cleaned, which is held in a vertical position and is movable vertically. Disposed in a horizontal position in the upper part of the cleaning tank 30 are nozzles 20 arranged in a circular configuration having an inside space through which the vertically held the aluminum drum 10 can be passed. The nozzles 20 are adapted to spray a cleaning fluid toward the inside space.

Degreasing solvents such as dichloromethane, for example, are suitably used as cleaning fluid 40 for cleaning the aluminum drum 10 used in the manufacture of a photoconductor drum. The cleaning fluid 40 is sucked through a drain passage 31 by means of a pump 50. The discharge pressure of the pump 50 is so set that the cleaning fluid is sprayed through the nozzles 20 under high pressure, for example, a pressure of about 50 kg/cm$^2$, is suitable for the cleaning of the aluminum drum 10.

A primary fluid passage 60 is provided for connection between the pump 50 and the nozzles 20 in the cleaning tank 30. In the primary fluid passage 60, a pair of solenoid valves 61 and 62 are disposed in this order down the current of the cleaning fluid, and further downstream thereof, there are disposed a primary filter 63 and a solenoid valve 64 in this order down the current of the cleaning solution, the solenoid valve 64 disposed downmost being made to communicate with the nozzles 20. The primary filter 63 is formed from a coarse filter, for example, having a pore size of about 10 μm and capable of withstanding a high pressure of about 50 kg/cm$^2$. A secondary fluid passage 70 branches from the primary fluid passage 60 at a portion between the pair of solenoid valves 61 and 62 disposed in the upper stream section thereof, the farther end of the secondary fluid passage 70 being connected to the primary fluid passage 60 at a portion downstream of the solenoid valve 64. In the secondary fluid passage 70, there are disposed a solenoid valve 71, a finishing filter 72, and a solenoid valve 73 in this order down the current of the cleaning fluid. The finishing filter 72 is formed from a fine filter having a pore size of about 0.2 μm, which is the maximum allowable size of foreign particles to be deposited on the aluminum drum 10 after cleaning. A bypass passage 80 branches from the primary fluid passage 60 at a portion upstream of the solenoid valve 61, the farther end of the bypass passage 80 being connected to the lower part of the cleaning tank 30. The bypass passage 80 is provided therein with a solenoid valve 81 capable of adjusting the flow rate.

In the drum cleaning method of the present invention which is carried out utilizing the above device of the invention, a primary cleaning process is first performed in which the outer circumferential surface of the aluminum drum 10 is cleaned by spraying thereon a cleaning fluid under high pressure. In the primary cleaning process, the solenoid valves 61, 62, and 64 in the primary fluid passage 60 are all put in an open condition, while the solenoid valves 71 and 73 in the secondary fluid passage 70 and the solenoid valve 81 in the bypass passage 80 are put in a closed condition. In these circumstances, when the pump 50 is driven, the pump 50 sucks the cleaning fluid 40 contained in the cleaning tank 30 through the drain passage 31. The pump 50 then pressurizes the thus sucked cleaning solution to a high pressure of about 50 kg/cm$^2$, for example, for discharging therefrom. Since the solenoid valves 61, 62, and 64 in the primary fluid passage 60 are all open while the other solenoid valves 71, 73, and 81 are all closed, the high-pressure cleaning fluid discharged from the pump 50 flows through the primary fluid passage 60, passing through the primary filter 63 disposed therein, and is sprayed out of the nozzles 20 disposed in the cleaning tank 30. Since the cleaning fluid passed through the primary filter 63 reaches the nozzles 20 with almost no pressure loss, the cleaning fluid is sprayed out of the nozzles 20 under a high pressure of about 50 kg/cm$^2$.

In such circumstances, the aluminum drum 10 is passed vertically through the inner space surrounded by the nozzles 20 while being rotated as necessary. Thus, the cleaning fluid is sprayed under a high pressure of about 50 kg/cm$^2$ onto the outer circumferential surface of the aluminum drum 10. As a result, metal powder, grease, and other foreign particles adhering to the outer circumferential surface of the aluminum drum 10 are effectively removed by mechanical energy. The cleaning fluid used for cleaning the outer circumferential surface of the aluminum drum 10 is collected in the cleaning tank 30, after which it is sucked by the pump 50, flows through the primary fluid passage 60, and is cleaned with the primary filter 63 for recirculation by the nozzles 20. Relatively large foreign particles contained in the cleaning solution used for cleaning the outer circumferential surface of the aluminum drum 10 are removed when the cleaning solution passes through the primary filter 63. Foreign particles unable to be trapped by the primary filter 63 may be redeposited on the drum 10.

In the meantime, the aluminum drum 10 is moved up and down a couple of times through the inside space surrounded by the nozzles 20 to complete the primary cleaning process. After that, to perform a final cleaning process, the solenoid valves 62 and 64 disposed opposite each other across the primary filter 63 in the primary fluid passage 60 are put in a closed condition, while the solenoid valves 71 and 73 in the secondary fluid passage 70 and the solenoid valve 81 in the bypass passage 80 are put in an open condition. This causes a portion of the cleaning fluid discharged from the pump 50 to pass through the bypass passage 80 and flow directly into the cleaning tank 30, while the remainder of the cleaning fluid is caused to flow through the secondary fluid passage 70 under a reduced pressure. The cleaning fluid admitted into the secondary fluid passage 70 is cleaned with the finishing filter 72 and is fed to the nozzles 20 in the cleaning tank 30. The solenoid valve 81 provided in the bypass passage 80 works to modulate the flow rate of the cleaning fluid branching into the bypass passage 80 in such a way that the cleaning fluid admitted into the secondary fluid passage 70 flows through the finishing filter 72 under a prescribed pressure.

In these circumstances, the aluminum drum 10 is once again passed in rotating fashion through the inside space surrounded by the nozzles 20. Thus, the cleaning fluid is sprayed under a relatively low pressure from the nozzles 20 onto the outer circumferential surface of the aluminum drum 10. If very fine foreign particles are deposited on the outer circumferential surface of the aluminum drum 10, since these particles had once been removed from the outer circumferential surface of the aluminum drum 10 in the course of the preceding cleaning process using high-pressure cleaning fluid, such foreign particles can be completely removed from the aluminum drum 10 by the cleaning fluid sprayed from the nozzles 20 under a relatively low pressure. The cleaning fluid used for cleaning the aluminum drum 10 and collected in the cleaning tank 30 is cleaned with the finishing filter 72 while passing once again through the secondary fluid passage 70. Since the finishing filter has a fine porous structure of about 0.2 μm which is the minimum size of foreign particles that must be removed after cleaning the aluminum drum 10, the cleaned cleaning fluid does not contain fine foreign particles, the adherence of which to the aluminum drum 10 may cause a problem. Thus the possibility of redeposition to the outer circumferential surface of the aluminum drum 10 of foreign particles that may cause a problem when the aluminum drum 10 is cleaned with the cleaned cleaning fluid is eliminated. Further, since the cleaning fluid is passed through the finishing filter 72 under low pressure, there is no possibility of damage to the finishing filter 72.

By thus cleaning the aluminum drum 10, even fine foreign particles adhering to the outer circumferential surface of the aluminum drum 10 are completed removed therefrom. Furthermore, the above method requires the provision of only two filters, the primary filter 63 and the finishing filter 72, for cleaning the cleaning fluid.

In the above embodiment, one pump is used to circulate the cleaning fluid by switching between the primary fluid passage 60 provided with the primary filter 63 and the secondary fluid passage 70 provided with the finishing filter 72, but it will be appreciated that the application of the invention is not limited to the above embodiment. For example, a pump for circulating the cleaning fluid through the primary fluid passage 60 provided with the primary filter 63 may be provided separately from a pump for circulating the cleaning fluid through the secondary fluid passage 70 provided with the finishing filter 72 so that the cleaning fluid is circulated first through the primary fluid passage 60 for high-pressure cleaning and then through the secondary fluid passage 70 for high-precision cleaning.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A method of cleaning a drum by spraying a cleaning fluid on the outer circumferential surface of said drum to clean thereon, wherein the cleaning fluid is pumped out from a pump under a prescribed pressure and flows selectively through a primary fluid passage provided with a primary filter having a relatively coarse porous structure or through a secondary fluid passage provided with a finishing filter having a relatively fine porous structure so as to remove from the cleaning fluid foreign matter which is bigger than or equal to a prescribed size finally to be supplied to a plurality of nozzles for spraying therefrom, comprising the steps of:

sending a cleaning fluid at the prescribed pressure pumped out from the pump to the primary fluid passage;

passing the cleaning fluid at the prescribed pressure through the primary filter so as to clean the outer circumferential surface of said drum by spraying the cleaning fluid thereon through the plurality of nozzles;

sending a cleaning fluid pumped out from the pump to the secondary fluid passage and at the same time preventing part of the cleaning fluid from flowing therethrough; and passing part of the cleaning fluid at the prescribed pressure through the finishing filter so as to clean the outer circumferential surface of said drum by spraying the cleaning fluid thereon through the plurality of nozzles; and said primary filter having a porous filter structure such that particles having a size greater than about 10 μm are filtered out of the cleaning fluid, such that the cleaning fluid passing through said primary filter at a relatively high pressure of about 50 $kg/cm^2$ does not lose most of the pressure thereof in passing through said primary filter.

2. A method of cleaning a drum according to claim 1, wherein said drum is a photoconductive drum which is adapted to have a photoconductive layer applied on said circumferential surface after conducting of a final cleaning process.

3. A method of cleaning a drum according to claim 2, wherein said secondary filter means has a relatively fine porous structure of said secondary filter means such that foreign matter is removed which has a particle size greater than or equal to about 0.2 μm in size.

* * * * *